United States Patent [19]

Mourabet et al.

[11] Patent Number: 5,029,452

[45] Date of Patent: Jul. 9, 1991

[54] ACCESS PANEL INCLUDING DETACHABLE PORTION TO ACCOMMODATE PIPE PENETRATION

[75] Inventors: Amer N. Mourabet; James M. Grigsby, both of Clarksville, Tenn.

[73] Assignee: American Standard Inc., New York, N.Y.

[21] Appl. No.: 600,331

[22] Filed: Jan. 19, 1990

[51] Int. Cl.[5] ..... F25D 19/00

[52] U.S. Cl. ..... 62/298; 62/506; 49/464; 220/242; 220/266

[58] Field of Search ..... 62/506, 298; 248/56, 248/909; 220/242, 266; 49/464; 174/65 R, 67

[56] References Cited

U.S. PATENT DOCUMENTS 3,915,530 10/1975 Anderson et al. ..... 62/298

4,079,838 3/1978 Graqaum ..... 220/266

*Primary Examiner*—Albert J. Makay
*Assistant Examiner*—John Sollecito
*Attorney, Agent, or Firm*—William J. Beres; William O'Driscoll

[57] ABSTRACT

This invention relates to cover panels for enclosures, such as those found on the sides or roofs of buildings, which house air conditioning equipment. More particularly, this invention relates to a cover panel for an air conditioning enclosure which both accommodates the penetration of piping through it and allows for access to the interior of the enclosure, subsequent to the hookup of the piping to air conditioning system components housed within the enclosure, without the need to break a piping connection.

19 Claims, 2 Drawing Sheets

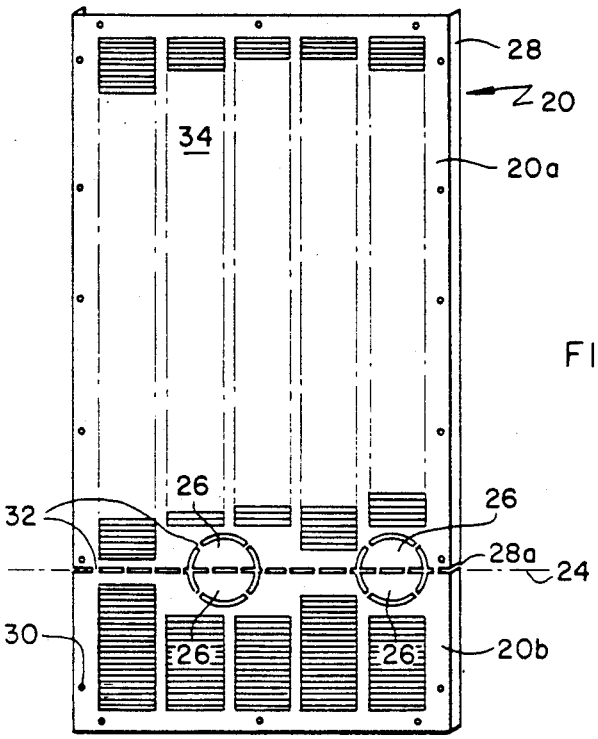
FIG. 3
FIG. 4
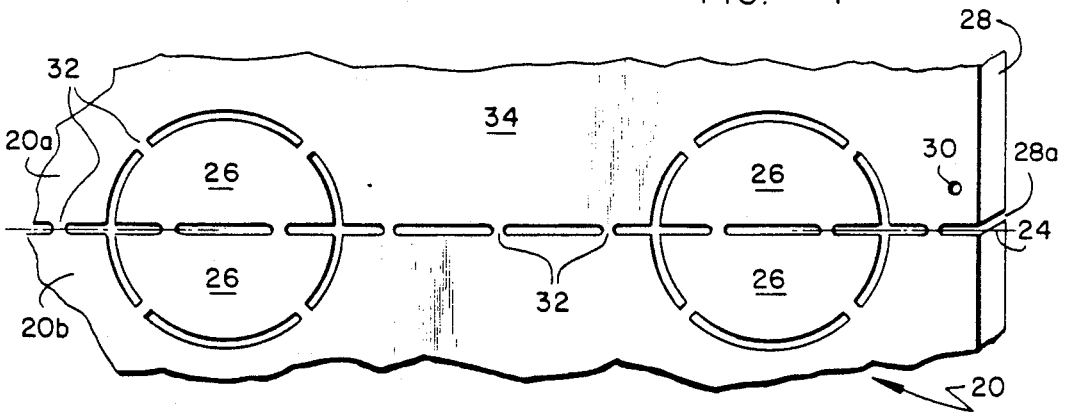
FIG 5
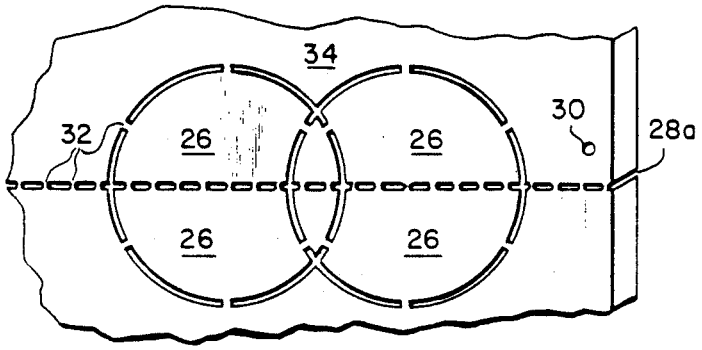

ACCESS PANEL INCLUDING DETACHABLE PORTION TO ACCOMMODATE PIPE PENETRATION

BACKGROUND OF THE INVENTION

Air conditioning equipment, commonly used in commercial and light-commercial applications, is often housed in an enclosure or cabinet disposed on the roof or at the side of the building which it serves. Such housings are typically comprised of a metal framework to the sides of which louvered cover panels are affixed. In some instances, particularly with respect to air conditioning equipment of the type known as air-cooled water chillers, piping may be required to penetrate the sides of the enclosure to allow for the connection of the piping to air conditioning system components housed inside the enclosure.

Because the connection of such piping to the air conditioning equipment components housed internal of the enclosure occurs in the field and because the removal of enclosure cover panels may be necessary subsequent to the equipment's initial installation in order to allow for access to components and connections interior of the enclosure, the need exists for a cover panel for air conditioning enclosures which accommodates the penetration of field installed piping in a manner which allows for subsequent removal of the cover panel, without the need to break a piping connection, yet which does not substantially detract from the strength or rigidity of the panel or its ability to securely protect the components housed within the enclosure.

SUMMARY OF THE INVENTION

It is an object of the present invention to provide a cover panel for an air conditioning cabinet which facilitates the field installation of piping which penetrates the panel.

It is a further object of the present invention to provide a louvered cover panel for an air conditioning enclosure which accommodates the penetration of field installed piping and which is likewise usable, without modification, on cabinets not requiring pipe penetrations in order to allow for the standardization of cover panel manufacture.

It is a still further object of the present invention to provide a cover panel for an air conditioning enclosure which eliminates the need for a field installer to cut the panel to allow for pipe penetration and hookup to components internal of the enclosure.

It is another object of the present invention to provide a cover panel for an air conditioning enclosure which is capable of rapid and standardized field modification, to accommodate the penetration of piping, without the use of tools.

It is a further object of the present invention to provide a cover panel for an air conditioning enclosure which is capable of being penetrated by piping yet which is removable to allow for access to the interior of the enclosure subsequent to the field installation of the piping without the need to break a piping connection.

It is a still further object of the present invention to provide a cover panel for an air conditioning enclosure which minimizes fabrication costs, reduces field installation costs and efforts and which does not detract from the strength, appearance or protective aspects of the panel.

These and other objects of the present invention, which will become apparent when the attached drawing figures are considered in view of the Description of the Preferred Embodiment set forth below, are accomplished by an access panel for an air conditioning cabinet which is capable of being broken into two discrete portions and which further includes selectively removable portions which, upon their removal, define pipe penetration access holes of predetermined size at predetermined locations.

The panel of the present invention includes upper and lower portions that are capable of being broken away from each other in the field by bending the panel to the point of separation into discrete portions on a predetermined pre-weakened axis. In instances where no piping need be hooked up to the equipment housed interior of the enclosure on which the panel is used, the access panel is untouched during the course of installation of the equipment and remains a unitary member. Where, however, the equipment housed interior of the enclosure is such that the penetration of piping through the cover panel must be accommodated, the cover panel is removed, bent along its predetermined weakened axis and is broken in two. Prepositioned removable portions disposed at locations on the panel through which pipe penetration is to be accommodated are then removed from the panel.

The necessary piping is run into the enclosure and is connected to the appropriate air conditioning component housed in the cabinet while the panel is removed. The two broken-away portions of the cover panel are then reattached to the air conditioning enclosure with the result that the now-installed piping penetrates the cover panel in the prepositioned locations, where the removable panel portions were previously disposed, with a small clearance being defined around the piping by the two reattached panel portions.

As a result, the strength and rigidity of the cover panel as well as its ability to function to protect the air conditioning components housed interior of the enclosure go essentially uncompromised. The need for cutting the panel to allow for pipe penetration, which would otherwise compromise the strength and integrity of the enclosure as well as detract from its aesthetic appearance, is avoided yet access can be gained to the interior of the enclosure at the location of the panel without the need to break a piping connection.

DESCRIPTION OF THE DRAWING FIGURES

FIG. 3 is a perspective view of the cover panel of the present invention.

FIG. 4 is a close-up view of the perforated portion of the cover panel of FIG. 3.

FIG. 5 illustrates an alternative embodiment of the cover panel of the present invention.

DESCRIPTION OF THE PREFERRED EMBODIMENT

Figure 1:
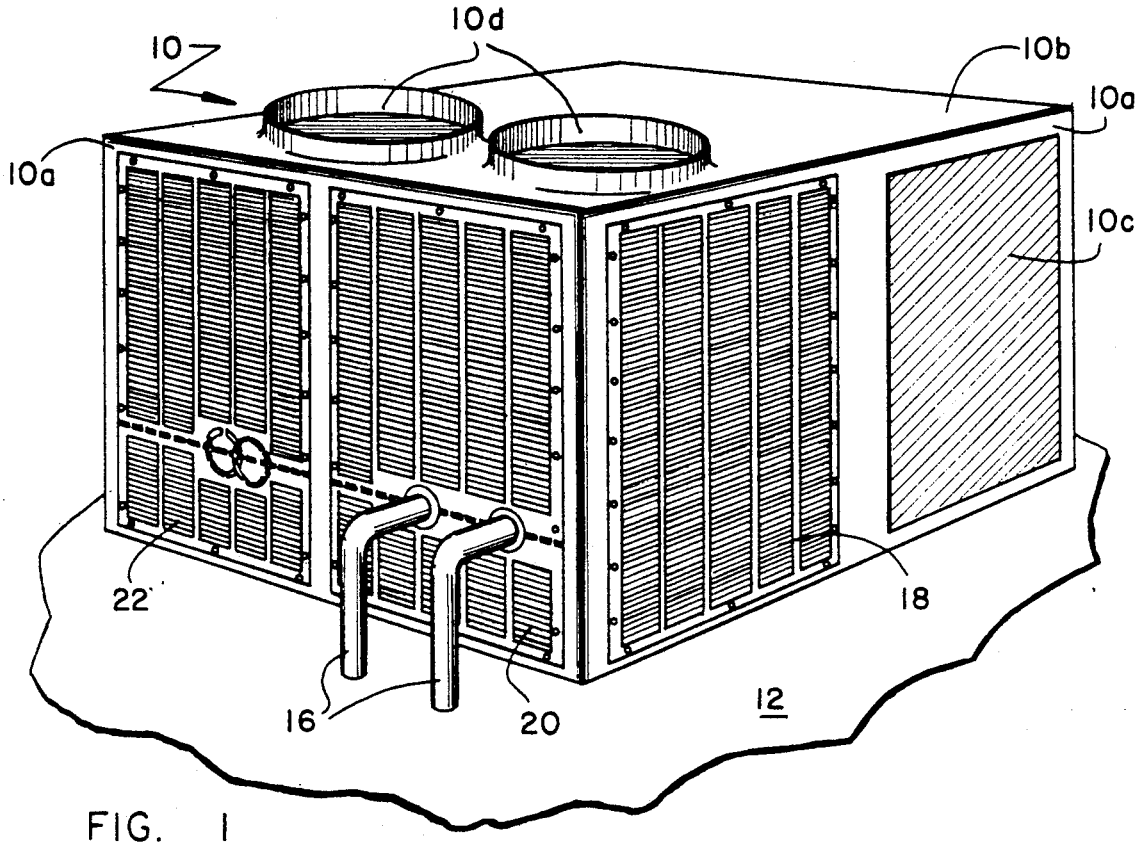
FIG. 1 is a perspective view of an air conditioner apparatus employing the cabinet cover panel of the present invention.
Figure 2:
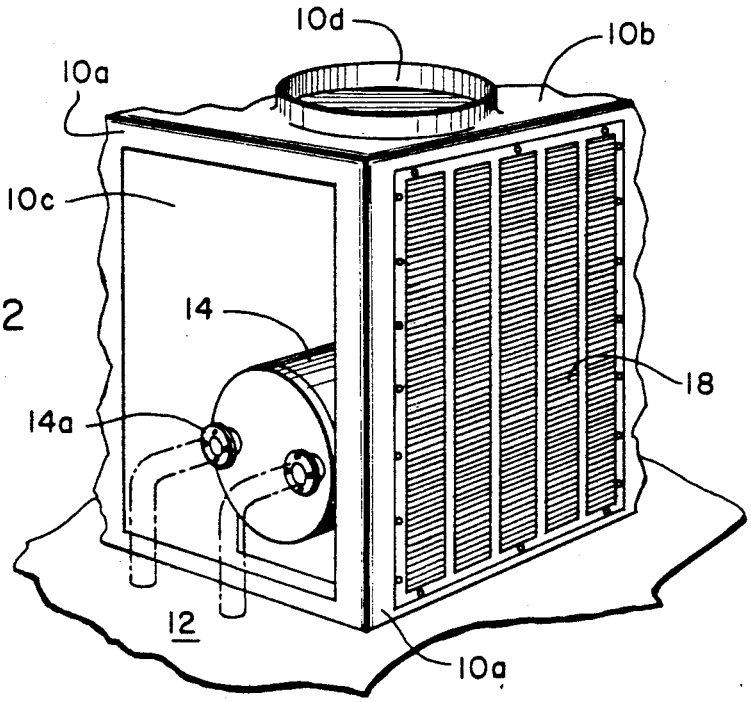
FIG. 2 is a partial view of the apparatus of FIG. 1 with the piping and panel of FIG. 1 removed.

Referring initially to FIGS. 1 and 2, air conditioning enclosure 10 is of the type which, as illustrated, is disposed on the roof 12 of a building. Alternatively, equipment of this nature may be disposed on ground level at the side of a building The air conditioning equipment illustrated in FIG. 1 is of the type known as an air-cooled water chiller. Although the present invention will be described in terms of its application to air-cooled water chillers, it will be appreciated that the present invention has application with respect to any air conditioning enclosure required to be penetrated by piping or tubing.

Enclosure 10 has side members 10*a* and a top member 10*b* which defines fan orifices 10*d* in which are disposed fans (not shown) that operate to draw air through the louvered cover panels which are affixed to the side members 10*a* of the enclosure. The side members 10*a* of enclosure 10 may be comprised of a relatively open or skeletal framework or of sheet metal sides, attached to a skeletal framework, which define relatively large openings. Air is drawn through the louvered cover panels, which cover the openings in the side members 10*a* of the enclosure, and passes through a heat exchanger and/or is directed over components for cooling purposes before being discharged by the fans upward and out of the top member 10*b* through the fan orifices 10*d*.

Air-cooled water chillers include components housed in enclosures such as enclosure 10 that are significantly different than the components of other types of air conditioning equipment which can likewise be housed in enclosures such as enclosure 10. Air-cooled water chillers are unique in that piping such as water piping 16 may be required to be hooked up to components, such as heat exchanger 14, that are disposed internal of the enclosure.

As is best illustrated in FIG. 2, which illustrates the disposition of heat exchanger 14 with piping 16 and cover panel 20 of FIG. 1 removed, heat exchanger 14 is disposed internal of enclosure 10 and includes pipe connections such as flanges 14*a* to which piping 16 is connected. As alluded to above, enclosures such as enclosure 10 can alternatively house air conditioning equipment which does not require the hookup of piping such as water piping 16 or the penetration of its sides by such piping.

Referring concurrently now to all of the drawing figures, enclosure 10 defines openings such as opening 10*c* in its side members 10*a* which are covered such as by louvered access panels 18, 20 and 22. Panel 18 is of a type previously known and is comprised of a unitary piece of sheet metal into which louvers have been formed and which is attached, such as by sheet metal screws, to the side of enclosure 10 so as to cover an opening thereinto in a manner which allows for air to be drawn through the cover panel.

Cover panel 20, the cover panel of the present invention, is a panel which, as fabricated and initially installed on enclosure 10, is likewise a unitary piece of sheet metal. However, as will be appreciated in viewing FIG. 3 in particular, cover panel 20 includes a first portion 20*a* and a second portion 20*b* which are disposed on either side of a perforated axis 24. The perforation of panel 20 on axis 24 allows for the bending of panel 20, upon its removal from enclosure 10, in a manner which will result in the breaking of panel 20 into two discrete and separate portions 20*a* and 20*b*.

Cover panel 22 is the same panel as panel 20 but, as is illustrated in FIGS. 1 and 3, but, is disposed over an opening in the side of enclosure 10 which does not require the penetration of piping and includes overlapping removable portions 26 as is best illustrated in FIG. 5.

It will be appreciated that enclosure 10 might employ cover panels only of the type of panel 20 or might employ only one type 20 panel in an appropriate location with the remainder of the panels being type 18 panels. It will also be appreciated that if type 20 panels are exclusively employed, only one standardized cover panel need be employed on the enclosure irrespective of the nature and location of the air conditioning equipment housed inside it or the need for pipe penetration or lack thereof.

Referring primarily now to FIG. 4, it will be seen that portions 20*a* and 20*b* of panel 20, each of which may include louvers, include discrete semicircular removable portions 26 which are formed by additionally perforating panel 20 in a circular or other appropriate manner at predetermined locations about weakened axis 24. Removable portions 26 have at least one side or edge which cooperates with the panel portion to which it is attached to define axis 24. Panel 20 also includes edge portions 28 and defines a plurality of holes 30 through which sheet metal screws (not shown) penetrate to connect panel 20 to accommodating surfaces of side members 10*a* enclosure 10.

The perforations on axis 24 and around removable portions 26 of panel 20 weaken panel 20 and predispose it for separation along the perforations. The perforations are at a height such that when removable portions 26 are removed, access holes, through which the penetration of piping is accommodated, are defined in panel 20 at a predetermined height and location to facilitate the connection of the piping 16 to air conditioning component connections, such as flanges 14*a*, which are disposed at a cooperating height and location within enclosure 10.

It will be noted that edges 28 of panel 20 are slotted for their entire width at the level of axis 24 so as to define a gap 28*a* in edge 28. Panel portions 20*a* and 20*b*, as fabricated and initially installed on enclosure 10, are therefore physically connected only by relatively very small connecting portions 32 on the face 34 of the cover panel.

It will be apparent that if edges 28 were not slotted along their entire width to form a gap, panel 20 would be incapable of being easily bent along axis 24 which, once again, lies in the plane of face 34 of the cover panel. It will be appreciated, however, that the disposition of a connecting portion in gap 28*a* would not materially depart from the scope of this invention.

Because cover panel 20, when installed on the side of enclosure 10 is attached to the enclosure by a plurality of sheet metal screws, the breaking of panel 20 into two discrete portions 20*a* and 20*b* and the reattachment of those portions to enclosure 10 with the same screw fasteners subsequent to the installation of piping results in an aesthetic cover panel which is of essentially equal strength and rigidity to a unitary cover panel and which provides protection for the components interior of enclosure 10 equal to the protection offered by such unitary cover panels. More significantly, however, access to the interior of the enclosure can be gained through panel 20, by the removal of one or both of panel portions 20*a* and 20*b* even when penetrated by piping, without the need to break a piping connection.

It will be noted that removable portions 26 of panel 20 are sized to accommodate piping of a predetermined diameter so that when piping of the appropriate diameter is used, a relatively very small clearance is maintained around and between the piping and the accommodating opening defined by portions 20*a* and 20*b* of panel 20. It will also be noted that in order to allow for the initial handling and assembly of panel 20 to enclosure 10, connecting portions 32 must provide sufficient strength and rigidity to the panel to allow for the avoidance of the inadvertent breaking of panel 20 into two pieces during the process of its initial handling and assembly onto enclosure 10 at the point of manufacture.

When air conditioning enclosure 10 is shipped from its point of manufacture, panel 20 is attached by sheet metal screws to a side member thereof and is a unitary piece in which portions 20*a* and 20*b* are connected by connecting portions 32 and in which removable portions 26 are likewise connected to the panel by connecting portions 32. If the equipment housed within enclosure 10 is of the type which does not require the penetration of piping through a cover panel thereof, panel 20 remains a unitary piece attached to the side of enclosure 10 and will typically be untouched by the equipment installer.

If, however, the air conditioning equipment housed within enclosure 10 is such that the hookup of piping to the equipment and the penetration of such piping through a cover panel is required, panel 20 is removed by the field installer, the piping is run through the open side of enclosure 10 and the necessary internal pipe connections are made. Panel 20 is bent along axis 24 resulting in the eventual weakening and breaking of connecting portions 32 along axis 24 such that portions 20*a* and 20*b* of panel 20 become separated.

The appropriate removable portions 26 of the panel, which may comprise some or all of the removable portions 26 disposed on the panel, are likewise broken away from the respective portions 20*a* and 20*b* of panel 20 to which they are attached, such as by twisting, with the result that prepositioned semicircular voids are defined in the locations in panel portions 20*a* and 20*b* where removable portions 26 were located prior to their removal.

It will be appreciated that the perforations in panel 20 can be made large enough and the connecting portions 32 small enough, given the secure and rigid attachment of both portions 20*a* and 20*b* of panel 20 to the enclosure by sheet metal screws, to ensure that panel 20 is sufficiently strong as a unitary piece so as to allow for its handling and assembly to the enclosure during cabinet manufacture without breakage yet sufficiently weakened along axis 24, when removed from the enclosure, such that it can be manually bent and broken along axis 24 and removable portions 26 can be manually twisted and removed in the field without the use of tools.

Once removed and broken into separate portions panel sections 20*a* and 20*b* are reattached to enclosure 10 such that the now vacated locations at which removable portions 26 were previously disposed fit closely around the piping which penetrates the reinstalled panel. Each of portions 20*a* and 20*b* of panel 20 are reattached to enclosure 10 by the same sheet metal screws at the same locations as shipped from the point of manufacture with the result that enclosure 10 has strong, secure and aesthetically pleasing cover panels, including those through which piping penetrates.

It will be appreciated that the nature and location of the perforations which define removable portions 26 can be modified or varied to accommodate many types and sizes of piping penetration. In the panel illustrated in FIG. 5 for instance, overlapping semicircular removable portions 26, such as those likewise shown on panel 22 of FIG. 1, are illustrated. Concentric perforations could likewise be employed so as to allow for the accommodation of pipes of a variety of sizes through a side panel of the type of panel 20. It will also be appreciated that panel 20 could be configured such that only one of panel portions 20*a* and 20*b* define a removable portion, where such removable portion in one panel portion only is large enough or is appropriately configured to accommodate the penetration of piping through it, without the need for the removal of any portion of the other panel portion.

While the present invention has been described in terms of a preferred embodiment, it will be appreciated that many modifications and equivalents to the invention are contemplated which are within its scope. Therefore, the present invention is not to be limited other than by the language of the claims which follow.

What is claim is:

1. Air conditioning apparatus comprising:

a framework having a side, said side defining an opening;

a heat exchanger disposed internal of said framework, said heat exchanger having a portion adapted for connection to a pipe;

a panel disposed over said opening in said framework, said panel having first and second separation portions, said first and second panel portions being connected along a predetermined weakened axis and at least one of said first and second panel portions defining a removable pipe access portion juxtaposed said heat exchanger pipe connection portion so that upon the removal of said removable portion said panel defines a pipe penetration access in said side of said framework, at least part of said removable portion being defined by said axis; and means for removably fastening said panel to said framework.

2. The apparatus according to claim 1 wherein each of said first and second panel portions define removable pipe access portions.

3. The apparatus according to claim 2 wherein a removable portion defined by said first panel portion is juxtaposed a removable portion defined by said second panel portion so that upon the removal of said removable portions said first and second panel portions cooperatively define a pipe access through said panel.

4. The apparatus according to claim 3 wherein said predetermined axis is comprised of a plurality of slots defined in said panel such that said panel is predisposed to being bent along said axis.

5. The apparatus according to claim 4 wherein each of said first and said second panel portions define semicircular removable portions so that upon the removal of said removable portions said first and second panel portions cooperate define a circular access through said panel.

6. The apparatus according to claim 5 wherein at least one of said first and second panel portions defines a plurality of louvers.

7. The apparatus according to claim 6 wherein said panel has an edge portion, said edge pointed portion defining a gap which is at least partially coincident with said predetermined weakened axis.

8. The apparatus according to claim 7 wherein each of said first and second panel portions have a plurality of removable portions.

9. The apparatus according to claim 7 wherein said first and second panel portions cooperate to define concentric circular removable portions.

10. The apparatus according to claim 8 wherein said panel portions define overlapping semicircular removable portions.

11. An air conditioner comprising:

an enclosure, said enclosure having a plurality of side members and a top member, at least one of said side members defining an opening therethrough;

a heat exchanger disposed internal of said enclosure, said heat exchanger having a pipe connection;

a panel, said panel being removably attached to said at least one side member so as to cover said opening, said panel defining a removable pipe access portion and having a weakened axis defining means for facilitating the severing of said panel along said predetermined weakened axis into a first and a second panel portion whereby upon the removal of said removable portion and the severing of said panel into said first and said second panel portions, the connection of a pipe to said heat exchanger pipe connection and the passage of said pipe through said panel and said opening in said side member is accommodated in a manner which allows for access to the interior of said enclosure, through said opening in said side member, subsequent to the attachment of piping to said heat exchanger pipe connection, by the removal of said first and said second panel portions and without the need to disconnect the piping from said heat exchanger pipe connection.

12. The air conditioner according to claim 11 wherein said removable pipe access portion is cooperatively defined by said first and said second panel portions.

13. The air conditioner according to claim 12 wherein a removable portion defined by said first panel portion in cooperation with said weaked axis is juxtaposed a removable portion defined by said second panel portion in cooperation with said weakened axis so that upon the removal of said removable portions from said first and said second panel portions a pipe access is cooperatively defined by said first and said second panel portions.

14. The apparatus according to claim 13 wherein said predetermined axis is comprised of a plurality of slots defined in said panel.

15. The air conditioner according to claim 14 wherein said juxtaposed removable portions of said first and said second panel portions are semicircular.

16. The air conditioner according to claim 15 wherein at least one of said first and said second panel portions defines a plurality of louvers.

17. The air conditioner according to claim 13 wherein said removable portions and said predetermined axis are defined by a plurality of slots.

18. The apparatus according to claim 17 wherein said first and said second panel portions cooperate to define concentric circular removable portions.

19. The air conditioner according to claim 17 wherein each of said panel portions define overlapping semicircular removable portions.

* * * * *

UNITED STATES PATENT AND TRADEMARK OFFICE

CERTIFICATE OF CORRECTION

PATENT NO. : 5,029,452

DATED : July 9, 1991

INVENTOR(S) : Amer N. Mourabet and James M. Grigsby

It is certified that error appears in the above-identified patent and that said Letters Patent is hereby corrected as shown below:

ON TITLE PAGE: Item #22: "Filed: Jan. 19, 1990" should be --Filed: October 19, 1990--.

Column 2, line 68, after the word "building" insert --.--.

Column 3, line 8, "10a" should be --10a--.

Claim 1, Column 6, line 27, "separation" should be --separable--.

Signed and Sealed this

Thirteenth Day of October, 1992

*Attest:*

DOUGLAS B. COMER

*Attesting Officer*

*Acting Commissioner of Patents and Trademarks*